US006885390B2

(12) United States Patent
Hoshino et al.

(10) Patent No.: US 6,885,390 B2
(45) Date of Patent: Apr. 26, 2005

(54) THERMALLY ACTIVATING APPARATUS OF THERMOSENSIBLE ADHERING SHEET AND PRINTER APPARATUS

(75) Inventors: Minoru Hoshino, Chiba (JP); Norimitsu Sambongi, Chiba (JP); Yoshinori Sato, Chiba (JP); Shinichi Yoshida, Chiba (JP)

(73) Assignee: SII P & S Inc., Chiba (JP)

( * ) Notice: Subject to any disclaimer, the term of this patent is extended or adjusted under 35 U.S.C. 154(b) by 101 days.

(21) Appl. No.: 10/607,372

(22) Filed: Jun. 26, 2003

(65) Prior Publication Data

US 2004/0066448 A1 Apr. 8, 2004

(30) Foreign Application Priority Data

Aug. 5, 2002 (JP) ..... 2002-226911

(51) Int. Cl.[7] ..... B41J 2/32
(52) U.S. Cl. ..... 347/171
(58) Field of Search ..... 347/171, 200, 347/202, 218, 220, 221

(56) References Cited

U.S. PATENT DOCUMENTS

| | | | | |
|---|---|---|---|---|
| 5,614,928 A | | 3/1997 | Matsuda | 347/2 |
| 5,856,650 A | | 1/1999 | Rise et al. | 219/216 |
| 5,986,683 A | * | 11/1999 | Sawano et al. | 347/171 |
| 6,043,834 A | * | 3/2000 | Torisawa | 347/218 |
| 6,172,698 B1 | | 1/2001 | Iwata et al. | 347/171 |
| 6,271,872 B1 | * | 8/2001 | Nagata | 347/171 |
| 6,501,495 B1 | * | 12/2002 | Ichikawa et al. | 347/171 |
| 2002/0090244 A1 | | 7/2002 | Wood et al. | 400/621 |

FOREIGN PATENT DOCUMENTS

| | | |
|---|---|---|
| EP | 1052177 | 11/2000 |

* cited by examiner

*Primary Examiner*—K. Feggins
(74) *Attorney, Agent, or Firm*—Adams & Wilks

(57) ABSTRACT

A thermally activating apparatus of a thermosensible adhering sheet at least having a thermally activating thermal head, a thermally activating platen roller and controlling means for controlling to process to drive these, having heating means (for example, thermally activating thermal head) for applying thermal energy to a remaining substance comprising a thermosensible adhesive or a denatured substance thereof or the like adhered to a thermally activating thermal head and a thermally activating platen roller, and carrying means (for example, thermally activating platen roller) capable of carrying a predetermined cleaning sheet by inserting the predetermined cleaning sheet into the thermally activating apparatus from a predetermined direction, in which the controlling means is constituted to be able to control to process to drive the heating means and the carrying means, the thermal energy is applied to the remaining substance by making the heating means generate heat in a state in which the thermosensible adhering sheet is not disposed between the thermally activating thermal head and the thermally activating platen roller, and the thermally activated remaining substance is transcribed onto the cleaning sheet to remove by carrying the cleaning sheet between the thermally activating thermal head and the thermally activating platen roller by operating the carrying means.

14 Claims, 7 Drawing Sheets

THERMALLY ACTIVATING APPARATUS OF THERMOSENSIBLE ADHERING SHEET AND PRINTER APPARATUS

BACKGROUND OF THE INVENTION

1. Field of the Invention

The present invention relates to a thermally activating apparatus of a thermosensible adhering sheet formed with a thermosensible adhesive layer showing a nonadhering property in normal time and manifesting an adhering property by being heated on one face of a sheet-like base member and used as, for example, an adhering label, particularly to a technology of cleaning a head or the like of a thermally activating apparatus constituting heating means by a thermal head.

2. Description of the Related Art

In recent years, a pasting label used as a POS label of a food product, a physical distribution/delivery label, a label for medical treatment, a baggage tag or a display label of bottles/cans, is frequently of a type having a pressure sensitive adhesive layer on a rear side of a printable face (record face) and storing in a state of pasting an exfoliating sheet (separator) thereon to tackedly adhere thereto. However, the pasting label of this type needs to exfoliate the exfoliating sheet from the pressure sensitive adhesive layer when used as the label and therefore, there is a drawback of necessarily bringing about waste.

Hence, as a system for dispensing with the exfoliating sheet, there have been developed a thermosensible adhering label provided with a thermosensible adhesive layer showing a nonadhering property in normal time and manifesting an adhering property by being heated on a rear face side (a side opposed to a printable face) of a label-like base member and a thermally activating apparatus for manifesting the adhering property by heating the thermosensible adhesive layer of the label. For example, JP-A-11-79152 discloses a technology for heating the thermosensible adhesive layer by bringing a head having a single or a plurality of resistance members (heat generating elements) provided above a ceramic board as a heat source as in a thermal head utilized as a printing head of a thermal printer apparatus.

FIG. 7 is an explanatory view showing a constitution of a conventional thermally activating apparatus. The thermally activating apparatus is constituted by a thermally activating platen roller 52 as carrying means for carrying a thermosensible adhering label 60 and a thermally activating thermal head 51 having a heat generating element 514 as heating means. Further, the thermally activating platen roller 52 functions also as a pressing member for pinching the thermosensible adhering label 60 between the thermally activating platen roller 52 and the thermally activating thermal head 51.

In FIG. 7, notation 510 designates a ceramic board as a heat radiating board on which a glaze layer 511 as a heat storing layer is formed over an entire face thereof by printing, for example, a glass paste and sintering the glass paste at predetermined temperatures (for example, about 1300 through 1500° C.). Further, a heat generating element (resistance member) 514 is formed and an electrode 512 for conducting electricity to the heat generating element 514 is formed in a predetermined pattern above the glaze layer 511. Further, an IC unit 515 for controlling to conduct electricity to the heat generating element 514 is formed above the glaze layer 511 and an upper side thereof is protected by a sealing portion 516 comprising a resin or the like. Further, a protective layer 513 comprising hard ceramics or the like is formed thereabove to prevent oxidation or wear of the electrode 512 and the heat generating element 514.

According to the above-described thermally activating apparatus, electricity is conducted to the heat generating element 514 in a state in which the thermosensible adhering label 60 is brought into contact with the protective layer 513, thermal energy provided thereby is applied to the thermosensible adhering label 60 via the protective layer 513 and therefore, thermal activation of the thermosensible adhesive layer is firmly carried out. Further, heat from the heat generating element 514 can efficiently be conducted to the thermosensible adhesive layer and therefore, an advantage of reducing power consumption is achieved.

However, according to the above-described thermally activating apparatus, the thermosensible adhesive layer is exposed from one face of the thermosensible adhering label 60 and therefore, there is observed a phenomenon in which remaining substances G1 and G3 comprising a portion of the thermosensible adhesive layer softened by being heated or a denatured product thereof are adhered to the thermally activating thermal head 51. Particularly, when heating means is constituted by the thermal head, it seems that the remaining substances are liable to adhere to the thermally activating thermal head 51 since the thermally activating thermal head 51 and the thermosensible adhesive layer are brought into contact with each other to directly heat.

Further, when the remaining substances G1 and G3 are gradually accumulated, an efficiency of conducting heat from the heat generating element 514 to the thermosensible adhesive layer is lowered and therefore, there poses a problem that the thermosensible adhesive does not manifest a sufficient adhering property in the same heating time period. In this case, although the thermal activation can be carried out sufficiently by prolonging the heating time period, when the time period is prolonged, power consumption is increased and a time control is needed and therefore, the control becomes complicated.

Further, a printing processing and a thermally activating processing are continuously carried out in a state of adhering the remaining substances G1 and G3 to the thermally activating thermal head 51 and therefore, the remaining substances G1 and G3 may be retranscribed to the thermosensible adhesive layer of the thermosensible adhering label 60 to deteriorate adhering force. Further, the remaining substances adhered to the thermally activating thermal head 51 are heated by a number of times and therefore, there is also brought about a drawback that the remaining substances are carbonized after elapse of a long period of time and cannot be removed easily.

Further, there is also a case in which the remaining substances G1 and G3 adhere to the peripheral face of the thermally activating platen roller 52 and in this case, there is a concern that a remaining substance G2 adheres to a side of a surface (printable face) of the thermosensible adhering label to contaminate a printing face. Further, when the remaining substance G3 on a side of inserting the thermosensible adhering label 60 is enlarged by continuous thermally activating processing (for example, thermally activating processing of a sheet length of 500 m), performance of inserting labels is deteriorated and there is a concern of bringing about sheet jamming.

Therefore, it is necessary to periodically clean the remaining substances of the thermosensible adhesive or the like adhered to the thermally activating thermal head 51, however, for cleaning the remaining substances, the thermally activating thermal head 51 needs to detach from the thermally activating apparatus 50 and therefore, considerable labor and time is needed. Further, in cleaning the remaining substances, it is necessary to interrupt the printing operation for a comparatively long period of time and shut off electricity conduction to the heat generating element 514 and therefore, continuous operation of a printer apparatus becomes difficult and an operational rate of the apparatus is lowered.

SUMMARY OF THE INVENTION

It is an object of the invention to provide a thermally activating apparatus of a thermosensible adhering sheet capable of easily removing a remaining substance comprising a thermosensible adhesive or a denatured substance thereof or the like adhered to a thermally activating thermal head and a thermally activating platen roller and a printing apparatus having the thermally activating apparatus.

The invention has been carried out in order to achieve the above-described object and is a thermally activating apparatus which is a thermally activating apparatus of a thermosensible adhering sheet comprising at least a thermally activating thermal head for heating to activate a thermosensible adhesive layer of the thermosensible adhering sheet constituted by respectively forming a printable face on one side of a sheet-like base member and the thermosensible adhesive layer on other face thereof, a thermally activating platen roller arranged to be opposed to the thermally activating thermal head for pinching the thermosensible adhering sheet between the thermally activating platen roller and the thermally activating thermal head to carry in a predetermined direction, and controlling means for controlling to drive the thermally activating thermal head and the thermally activating platen roller, in a state in which the thermosensible adhering sheet is not disposed between the thermally activating thermal head and the thermally activating platen roller, the controlling means applies a thermal energy to a remaining substance comprising a thermosensible adhesive or a denatured substance thereof or the like adhered to the thermally activating thermal head and the thermally activating platen roller by making the thermally activating thermal head generate heat and carries a cleaning sheet between the thermally activating platen roller and the thermally activating thermal head by rotating the thermally activating platen roller to thereby transcribe the thermally activated remaining substance onto the cleaning sheet to remove.

Or, the invention is a thermally activating apparatus which is a thermally activating apparatus of a thermosensible adhering sheet comprising at least a thermally activating thermal head for heating to activate a thermosensible adhesive layer of the thermosensible adhering sheet constituted by respectively forming a printable face on one side of a sheet-like base member and the thermosensible adhesive layer on other face thereof, a thermally activating platen roller arranged to be opposed to the thermally activating thermal head for pinching the thermosensible adhering sheet between the thermally activating platen roller and the thermally activating thermal head to carry in a predetermined direction, and controlling means for controlling to drive the thermally activating thermal head and the thermally activating platen roller, comprising heating means for applying a thermal energy to a remaining substance comprising a thermosensible adhesive or a denatured substance thereof or the like adhered to the thermally activating thermal head and the thermally activating platen roller, and carrying means capable of carrying a predetermined cleaning sheet into the thermally activating apparatus from a predetermined direction, wherein the controlling means is constituted to be able to control a processing of driving the heating means and carrying means for applying a thermal energy to the remaining substance by making the heating means generate heat in a state in which the thermosensible adhering sheet is not disposed between the thermally activating thermal head and the thermally activating platen roller and carrying the cleaning sheet between the thermally activating thermal head and the thermally activating platen roller by operating the carrying means to thereby transcribe the thermally activated remaining substance onto the cleaning sheet to remove.

That is, by applying the thermal energy to the remaining substance adhered to the thermally activating thermal head and the thermally activating platen roller by the heating means (for example, the thermally activating thermal head) to thermally activate and thereafter carrying the cleaning sheet by the carrying means (for example, the thermally activating platen roller and an inserting roller), the remaining substance adhered to the thermally activating platen roller is transcribed to a surface of the cleaning sheet to remove and the remaining substance adhered to the thermally activating thermal head is transcribed to a rear face thereof to remove.

Thereby, the remaining substance adhered to the thermally activating thermal head and the thermally activating platen roller can easily be removed and therefore, an efficiency of conducting heat from the thermally activating thermal head to the thermosensible adhering sheet is not extremely reduced and power consumption required for the thermally activating processing can be avoided from being increased. Further, in comparison of the conventional method of cleaning by disassembling the thermally activating apparatus, time and labor required for cleaning is reduced and therefore, a reduction in cost can be achieved.

Further, by making the thermally activating thermal head serves also to function as heating means for cleaning and making the thermally activating platen roller serve also to function as carrying means for cleaning, it is not necessary to separately provide the heating means and the carrying means and therefore, the apparatus can be constituted similar to the conventional thermally activating apparatus.

Further, when the thermal energy is applied to the remaining substance by the heating means or the thermally activating thermal head, the controlling means rotates the thermally activating platen roller in a predetermined direction. Here, the predetermined direction signifies a direction reverse to a rotational direction in carrying the cleaning sheet. For example, in the case in which the cleaning sheet is carried from the left side to the right side by rotating the thermally activating platen roller 52 in the counterclockwise direction in FIG. 7, when the thermal energy is applied to the remaining substance, the thermally activating platen roller 52 is rotated in the clockwise direction.

Thereby, the remaining substance (notation G3 of FIG. 7) adhered to the sheet inserting side of the thermally activating thermal head can be transcribed onto the thermally activating platen roller and can be adhered again to the sheet delivery side of the thermally activating thermal head as the remaining substance G1. That is by accumulating the remaining substance to the delivery side of the cleaning sheet, the remaining substance by carrying the cleaning sheet can be made to be easy to remove and inserting performance of the cleaning sheet can be promoted.

Further, after the cleaning sheet is inserted into the thermally activating apparatus to carry by a predetermined length by the carrying means or the thermally activating platen roller, the controlling means removes the remaining substance by moving the cleaning sheet frontwardly and rearwardly. For example, when the carrying means is constituted by the thermally activating platen roller, by regularly rotating and reversely rotating the thermally activating platen roller by a predetermined number of times (or angle), the cleaning sheet can be moved frontwardly and rearwardly.

Thereby, the remaining substance adhered to the thermally activating platen roller can be removed by transcribing operation and the remaining substance fixedly attached to the thermally activating thermal head (for example, remaining substance which is carbonized and is not thermally activated) can physically be removed by utilizing friction. Further, the frontward and rearward movement of the cleaning sheet can pertinently be set based on a degree of fixedly attaching the remaining substance. For example, the thermally activating platen roller may be set to rotate regularly for 3 seconds to carry the cleaning sheet and thereafter repeat to rotate regularly and rotate reversely for 1 second alternately by several times (for example, 3 times).

Further, the remaining substance can further effectively be removed by providing a shape which is easy to remove the adhering substance physically (for example, file-like shape) on the thermal head side of the cleaning sheet and providing a layer comprising a material to which the adhering substance is easy to transcribe on a platen roller side thereof.

Further, when the thermosensible adhering sheet is used as the cleaning sheet, before inserting the thermosensible adhering sheet into the thermally activating apparatus by operating the carrying means or the thermally activating platen roller, the controlling means stops applying the thermal energy to the remaining substance by the heating means or the thermally activating thermal head. That is, by stopping to apply the thermal energy to the remaining substance before inserting the thermosensible adhering sheet as the cleaning sheet into the thermal activating apparatus to thereby prevent the thermosensible adhesive of the inserted thermosensible adhering sheet from being thermally activated, the thermosensible adhering sheet can be used as the cleaning sheet. At this occasion, after stopping to apply the thermal energy to the remaining substance, the sheet may be inserted after several seconds such that thermosensible adhesive of the thermosensible adhering sheet is not thermally activated by the remaining heat.

Thereby, the thermosensible adhering sheet for printing can be utilized for cleaning as it is with no need of particularly preparing the cleaning sheet and therefore, the remaining substance is facilitated to remove and continuous operation and unmanned operation of the thermally activating apparatus can be carried out.

Further, the thermosensible adhering sheet is provided with sheet length measuring means for measuring a length subjected to the thermal activating processing and the controlling means executes the cleaning processing based on the sheet length measured by the sheet length measuring means.

That is, an amount of the remaining substance adhered to the thermally activating thermal head and the thermally activating platen roller is substantially proportional to the length of the thermosensible adhering sheet subjected to the thermally activating processing and therefore, by periodically removing the remaining substance while measuring the length of the sheet subjected to the thermally activating processing, the remaining substance can be prevented from effecting adverse influence on the thermally activating processing and the printing quality. Further, it is further effective to carry out cleaning when the power source of the apparatus is switched on or when the thermosensible adhering sheet is interchanged.

Further, it may be constituted that the controlling means can control a sheet carrying direction by the carrying means or the thermally activating platen roller based on a direction of inserting the cleaning sheet into the thermally activating apparatus. For example, according to the printer apparatus having the thermally activating apparatus, a printing apparatus or a cutter apparatus is installed on the sheet inserting side of the thermally activating apparatus and therefore, it is difficult to directly insert the cleaning sheet into the thermally activating apparatus and also when the cleaning sheet is inserted into the thermally activating apparatus via the printing apparatus and the cutter apparatus, time and labor is taken such that the thermosensible adhering label for printing needs to be interchanged by the cleaning sheet. Hence, the cleaning processing is made to execute even when the cleaning sheet is inserted from the sheet delivery side of the thermally activating apparatus.

Further, in a printer apparatus having the above-described thermally activating apparatus of the thermosensible adhering sheet and printing means for printing the thermosensible adhering sheet, in which the thermally activating apparatus and the printing means are controlled by the same control apparatus, a cleaning processing of the thermally activating apparatus is facilitated and the apparatus can be made to be maintenance free and therefore, continuous operation or unmanned operation of the printer apparatus can be carried out and an efficiency of producing a printed matter is significantly promoted.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

Preferred embodiments of the invention will be explained in details in reference to the drawings as follows.

Figure 1:
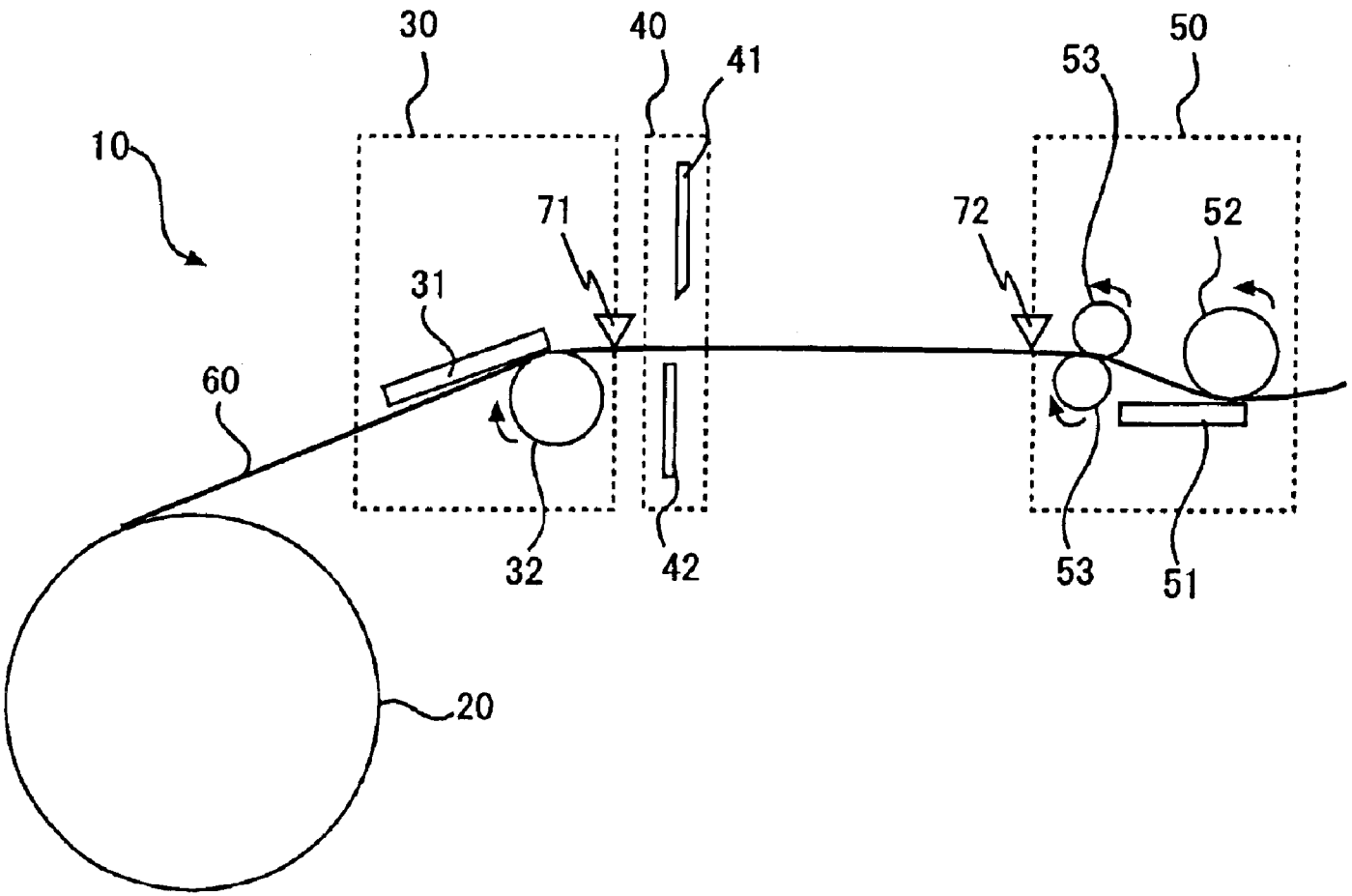
FIG. 1 is an outline view showing an example of constitutions of a thermally activating apparatus and a thermal printer apparatus using the thermally activating apparatus according to the invention.

FIG. 1 is an outline view showing constitutions of a thermally activating apparatus according to the invention and a thermal printer apparatus 10 utilizing the thermally activating apparatus. The thermal printer apparatus 10 is constituted by a roll containing unit 20 for holding a thermosensible adhering label 60 in a tape-like shape wound in a roll-like shape, a printing unit 30 for printing the thermosensible adhering label 60, a cutter unit 40 for cutting the thermosensible adhering label 60 in a predetermined length and a thermally activating unit 50 as a thermally activating apparatus for thermally activating a thermosensible adhesive layer of the thermosensible adhering label 60.

Although the thermosensible adhering label 60 used in the embodiment is not particularly restricted here, the thermosensible adhering label 60 is constituted by, for example, a structure in which a surface side of a label base member is formed with a heat insulating layer and a thermosensible color developing layer (printable face) and a rear face side thereof is formed with a thermosensible adhesive layer constituted by coating and drying a thermosensible adhesive. Further, the thermosensible adhesive layer comprises a thermosensible adhesive whose major component is a thermoplastic resin, a solid plastic resin or the like. Further, the thermosensible adhering label 60 may not be provided with the heat insulating layer or may be provided with a protective layer or a colored printing layer (previously printed layer) at a surface of a thermosensible color developing layer.

The printing unit 30 is constituted by a printing thermal head 31 having a plurality of heat generating elements (not illustrated) constituted by a plurality of comparatively small resistance members arranged in a width direction to be able to carry out dot printing, a printing platen roller 32 brought into press contact with the printing thermal head 31 and the like. Further, the printing thermal head 51 is constructed by a constitution similar to a printing head of a publicly-known thermal printer apparatus constituted by providing a protective film or the like at surfaces of the plurality of heat generating elements formed above a ceramic board and therefore, a detailed explanation thereof will be omitted.

Further, the printing unit 30 is provided with a driving system, not illustrated, comprising, for example, an electric motor, a gear train and the like for driving to rotate the printing platen roller 32 and by rotating the printing platen roller 32 in a predetermined direction by the driving system, the thermosensible adhering label 60 is drawn from the roll and carried in a predetermined direction while printing the drawn thermosensible adhering label 60 by the printing thermal head 31. In FIG. 1, the printing platen roller 32 is rotated in the clockwise direction and the thermosensible adhering label 60 is carried to the right side.

Further, the printing unit 30 is provided with pressing means, not illustrated, constituted by, for example, a helical spring, a leaf spring or the like and by spring force of the pressing means, the printing thermal head 31 is pressed to the printing platen roller 32. At this occasion, by maintaining a rotating shaft of the printing platen roller 32 and a direction of aligning the heat generating elements in parallel with each other, the printing thermal head 31 and the printing platen roller 32 can uniformly brought into press contact with each other over a total of the width direction of the thermosensible adhering label 60.

The cutter unit 40 is for cutting the thermosensible adhering label 60 printed by the printing unit 30 by a pertinent length and is constituted by a movable blade 41 operated by a drive source (not illustrated) of an electric motor or the like and a fixed blade 42 made to be opposed to the movable blade and the like.

The thermally activating unit 50 is constituted by a thermally activating thermal head 51 as heating means having the heat generating element, a thermally activating platen roller 52 as carrying means for carrying the thermosensible adhering label 60, an inserting roller 53 pivoted by, for example, a drive source, not illustrated, for pulling the thermosensible adhering label 60 supplied from a side of the printing unit 30 between the thermally activating thermal head 51 and the thermally activating platen roller 52 and the like.

According to the embodiment, the thermally activating thermal head 51 functions as heating means for cleaning and the thermally activating platen roller 52 functions as carrying means for cleaning.

Figure 7:
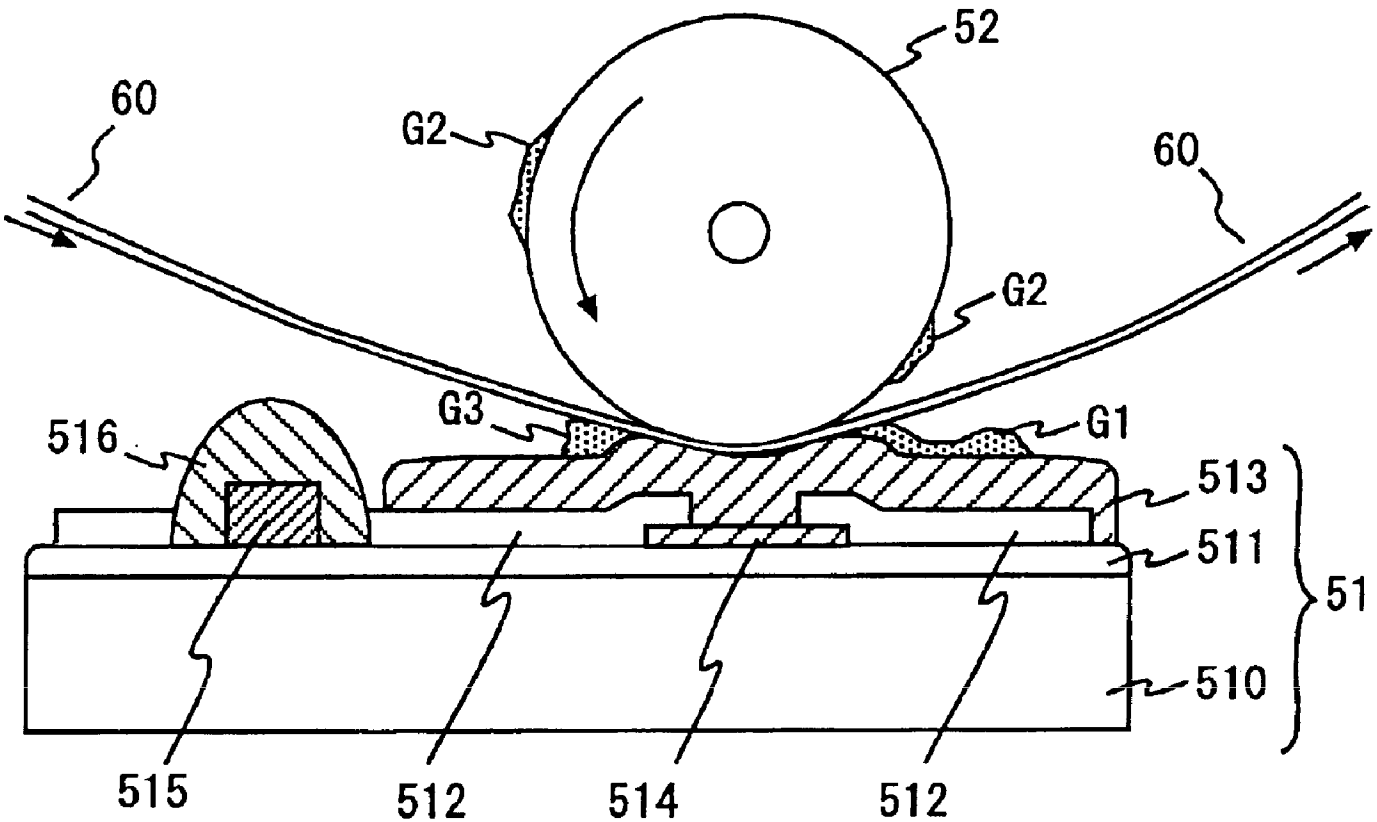
FIG. 7 PRIOR ART
FIG. 7 is an explanatory view showing an essential portion of a conventional thermally activating apparatus and a situation of adhering a remaining substance.

Further, there is used the thermally activating thermal head 51 having a constitution similar to that of the printing thermal head 32, that is, a constitution similar to that of a printing head of a publicly-known thermal printer apparatus constituted by providing a protective film or the like at surfaces of a plurality of heat generating elements formed above a ceramic board (refer to FIG. 7) according to the embodiment. However, the heat generating element of the thermally activating thermal head 51 needs not to be divided by a dot unit as in the heat generating element of the printing head but may be constituted by a continuous resistance member. Further, by using the thermally activating thermal head 51 having a constitution similar to that of the printing thermal head 31, a reduction in cost can be achieved by making parts thereof common.

Further, the thermally activating unit 50 is provided with a driving system comprising, for example, an electric motor, a gear train and the like for rotating the thermally activating platen roller 52 and by the driving system, the thermally activating platen roller 52 is rotated in a direction reverse to that of the printing platen roller 32 (counterclockwise direction in FIG. 1) to carry the thermosensible adhering label 60 in a predetermined direction (right side).

Further, the thermally activating unit 50 is provided with pressing means (for example, helical spring or leaf spring) for pressing the thermally activating thermal head 51 to the thermally activating platen roller 52. At this occasion, by maintaining a rotating shaft of the thermally activating platen roller 52 and a direction of aligning the heat generating elements in parallel with each other, the thermally activating thermal head 51 and the thermally activating platen roller 52 can be brought into press contact with each other uniformly over a total in the width direction of the thermosensible adhering label 60.

Further, the platen rollers 32 and 52 and the inserting roller 53 provided at the printing unit 30 and the thermally activating unit 50 are constituted by an elastic member of, for example, rubber, plastic, urethane, fluororesin, silicone resin or the like.

Figure 2:
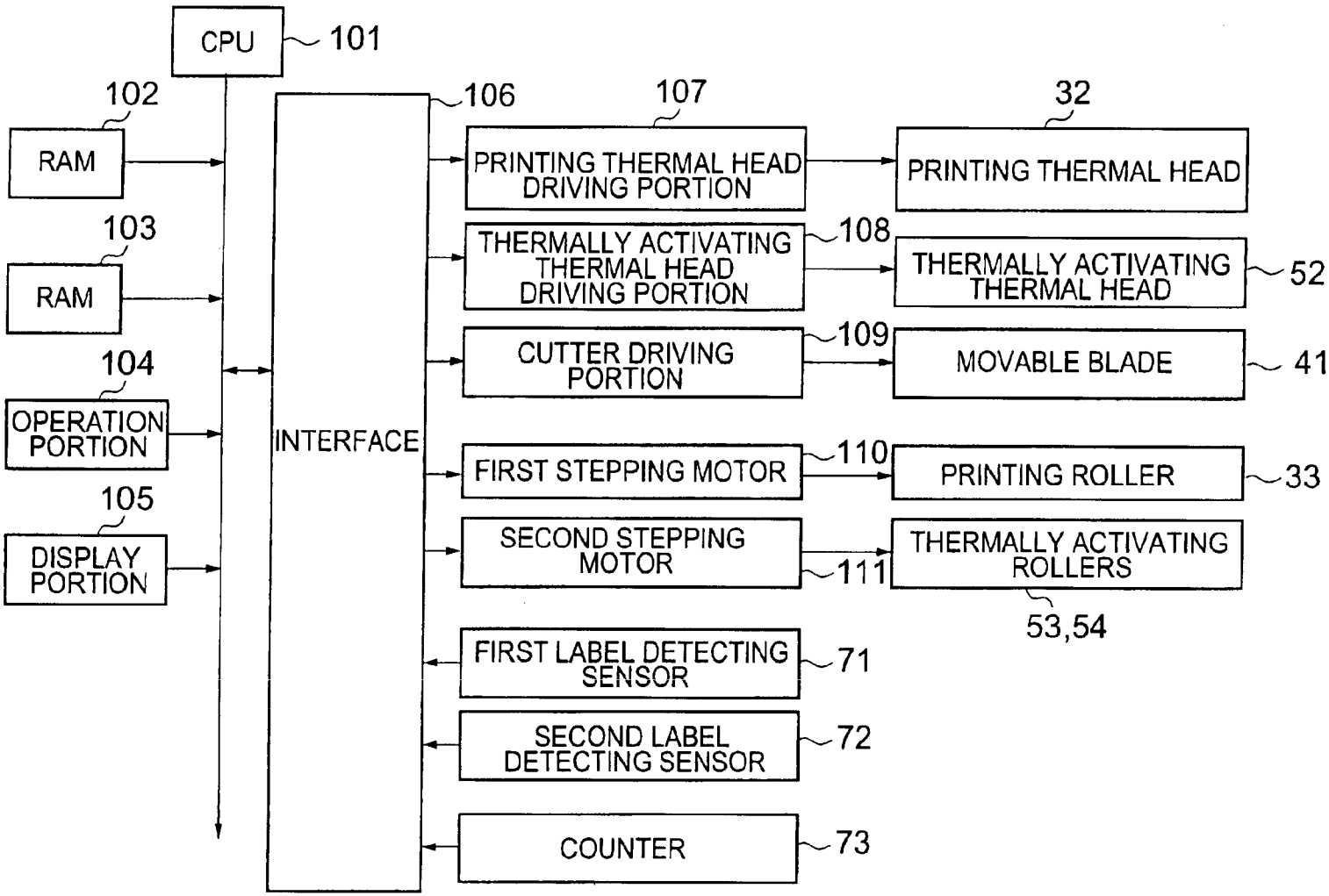
FIG. 2 is a block diagram showing a constitution example of a control system of a thermal printer apparatus.

FIG. 2 is a control block diagram of the thermal printer apparatus 10. A control portion of the printer apparatus 10 is constituted by CPU 101 for governing the control portion, ROM 102 for storing control programs and the like executed by CPU 101, RAM 103 for storing various printing formats and the like, an operating portion 104 for inputting, setting or calling printing data, printing format data or the like, a display portion 105 for displaying printing data or the like, an interface 106 for inputting and outputting data between the control portion and a drive portion, a driving circuit 107 for driving the printing thermal head 31, a driving circuit 108 for driving the thermally activating thermal head 51, a driving circuit 109 for driving the movable blade 41 for cutting the thermosensible adhering label 60, a first stepping motor 110 for driving the printing platen roller 32, a second stepping motor 111 for driving the thermally activating platen roller 52 and the inserting roller 53, label detecting sensors 71 and 72 for detecting presence or absence of the thermosensible adhering label and a counter 73 for measuring a label length of the thermosensible adhering label subjected to a thermal activating processing.

According to the embodiment, CPU 101 is constituted to be able to control to govern operation of the printing unit 30, the cutter unit 40 and the thermally activating unit 50 and constituted to be able to execute a cleaning control processing, mentioned later.

Further, the first label detecting sensor 71 is installed at a vicinity of a sheet delivering port of the printing unit 30 and the second label detecting sensor 72 is installed at a vicinity of a sheet delivering port of the thermally activating unit 50. Further, the counter 73 is utilized for determining a timing of starting the cleaning processing at the thermally activating unit 50 and CPU 101 as controlling means starts the cleaning processing based on the label length transmitted from the counter 73. Further, the label length for starting the cleaning processing can arbitrarily be set.

Next, an explanation will be given of a series of printing processings and thermally activating processings using the printer apparatus 10 according to the embodiment in reference to FIG. 1 and FIG. 2 as follows. Basically, based on a control signal transmitted from CPU 101, desired printing processings are executed at the printing unit 30, a cutting processing is executed at the cutter unit 40 at a predetermined timing and the thermally activating processings are executed at the thermally activating unit 50 by applying predetermined energy.

In details, first, the thermosensible adhering label 60 is drawn by rotating the printing platen roller 32 of the printing unit 30 and thermosensible printing is carried out on the printable face (thermosensible color developing layer) by the printing thermal head 32. Successively, the thermosensible adhering label 60 is carried to the thermally activating unit 50 by passing the cutter unit 40 by rotating the printing platen roller 32 and is taken into the thermally activating unit 50 by the inserting roller 53 and thereafter cut into a predetermined length by the movable blade 41 of the cutter unit 40 operated at a predetermined timing.

At this stage, CPU 101 starts controlling to heat the thermally activating thermal head 51 based on a detecting signal transmitted from the second label detecting sensor 72 provided at a front stage (sheet inserting side) of the thermally activating unit 50. Further, CPU 101 can carry the thermosensible adhering label 60 into the thermally activating unit 50 smoothly by rotating the inserting roller 53 and the thermally activating platen roller 52 by starting to drive the second stepping motor 111 in synchronism with the first stepping motor 110 with the detecting signal from the second label detecting sensor 72 as a trigger.

Successively, the thermosensible adhesive layer is heated by conducting electricity to the heat generating element at a predetermined timing in a state of pinching the thermosensible adhering label 60 by the thermally activating thermal head 51 and the thermally activating platen roller 52. Successively, the thermosensible adhering label 60 is delivered from the thermally activating unit 50 by rotating the thermally activating the platen roller 52 to thereby finish the series of printing processing and thermally activating processings.

Further, when CPU 101 determines that the thermosensible adhering label 60 has been discharged from the thermally activating unit 50 based on detection of a terminal end of the thermosensible adhering label by the second label detecting sensor 72, printing, carrying and thermally activating processings of a succeeding one of the thermosensible adhering label 60 may be carried out.

Next, an explanation will be given of cleaning processings of the thermally activating unit 50 at the printer apparatus 10 according to the embodiment. According to the embodiment, operation of the respective units 30, 40 and 50 is controlled based on a control signal transmitted from CPU 101. Further, in the following explanation, rotation of the platen roller when the thermosensible adhering label (or cleaning sheet) is carried to the right side is referred to as regular rotation and rotation thereof when the thermosensible adhering label (or cleaning sheet) is carried to the left side is referred to as reverse rotation. That is, in FIG. 1, regular rotation is constituted by clockwise rotation of the printing platen roller 32 and counterclockwise rotation of the thermally activating platen roller 52.

Figure 3:
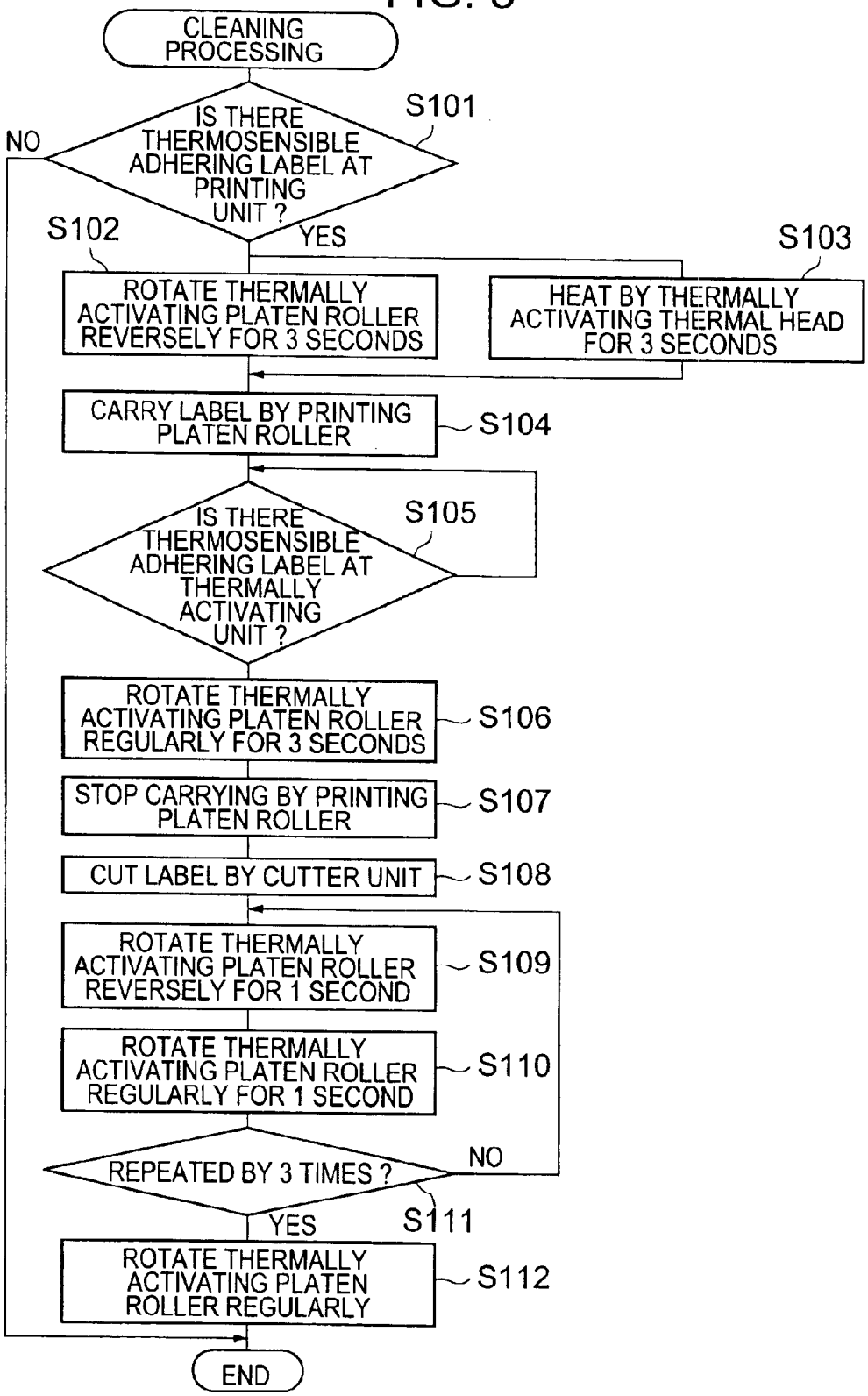
FIG. 3 is a flowchart with regard to a first example of a cleaning control processing.
Figure 4A:
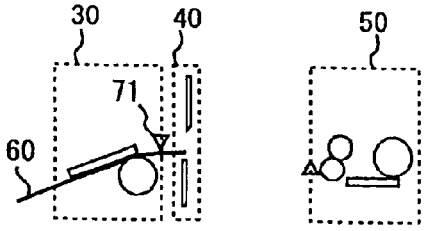
FIG. 4 illustrates operation explanatory views of the printer apparatus in a cleaning processing by the flowchart of FIG. 3.
Figure 4B:
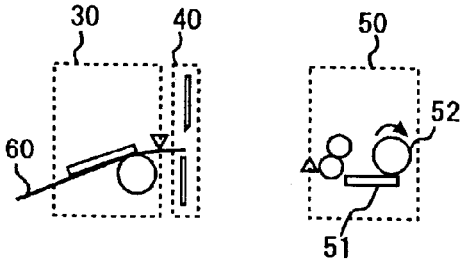
Figure 4C:
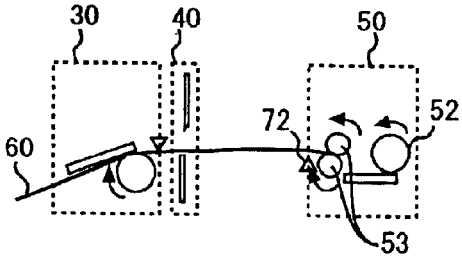
Figure 4D:
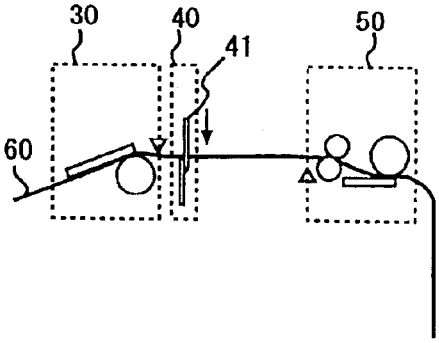
Figure 4E:
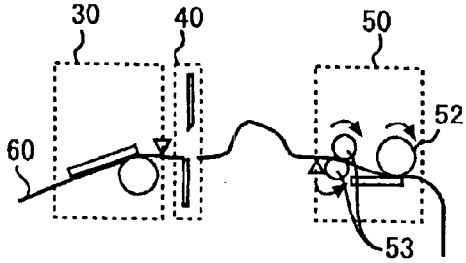
Figure 4F:
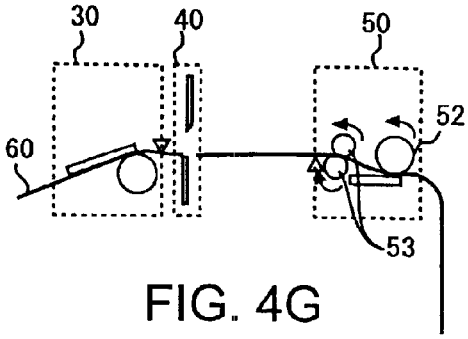
Figure 4G:
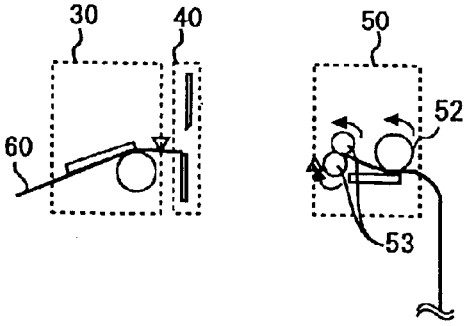

First, a first example of being processings according to the embodiment will be explained in reference to a flowchart of FIG. 3 and operation explanatory views of FIG. 4. According to the embodiment, the thermosensible adhering label 60 used for printing is used as cleaning sheet. Further, the cleaning processings are executed when a sheet length measured by the counter 73 becomes a predetermined sheet length (for example, 500 m), after switching on a power source of the printer apparatus or after attaching the thermosensible adhering label 60.

At step S101, it is determined whether the thermosensible adhering label 60 is present in the printing unit 30 (FIG. 4(*a*)). Specifically, it is determined based on the detecting signal from the first label detecting sensor 71 provided on the delivery port side of the printing unit 30. For example, in a state as shown by FIG. 4(*a*), it is determined that the thermosensible adhering label 60 is present at inside of the printing unit 30.

When it is determined that the thermosensible adhering label 60 is not present at step S101, the cleaning processings by the thermosensible adhering label 60 cannot be executed and therefore, the processings are finished as they are. Meanwhile, when it is determined that the thermosensible adhering label 60 is present, the operation proceeds to step S102 to rotate the thermally activating platen roller 52 reversely (clockwisely in FIG. 4) and heats the thermally activating platen roller 52 by the thermally activating thermal head 51 at step S103 (FIG. 4(*b*)). Further, processings at step S102 and at step S103 are carried out simultaneously and respective operation is stopped after 3 seconds.

That is, a remaining substance adhered to the thermally activating thermal head 51 and the thermally activating platen roller 52 is thermally activated to be brought into a state of being easily transcribed to the cleaning sheet by heating the remaining substance by the thermally activating thermal head 51. Further, by rotating the thermally activating platen roller 52 reversely, the remaining substance adhered to the sheet inserting side of the thermally activating thermal head 51 (notation G3 of FIG. 7) is transcribed to the thermally activating platen roller 52 and the transcribed remaining substance is made to adhere to the sheet delivery side of the thermally activating thermal head 51 to accumulate on the delivery side (notation G1 of FIG. 7). Thereby, the remaining substance by carrying the thermosensible adhering label 60 is facilitated to remove and inserting performance of the thermosensible adhering label 60 can be promoted.

Next, at step S104, the printing platen roller 32 is regularly rotated (clockwise rotation in FIG. 4) to start to carry the thermosensible adhering label 60. Further, at step 105, it is determined whether the thermosensible adhering label 60 arrives at the thermally activating unit 50 (FIG. 4(*c*)). Specifically, it is determined based on a detecting signal from the second label detecting sensor 72 provided on the sheet inserting port side of the thermally activating unit 50. For example, in a state as shown by FIG. 4(*c*), it is determined that the thermosensible adhering label 60 has arrived at the thermally activating unit 50.

Further, when it is determined that the thermosensible adhering label 60 has arrived at the thermally activating unit 50 at step S105, the operation proceeds to step S106 to rotate the thermally activating platen roller 52 and the inserting roller 53 regularly to carry the thermosensible adhering label 60 for 3 seconds in the thermally activating unit 50. Further, since the remaining substance adhered to the thermally activating thermal head 51 and the thermally activating platen roller 52 has been thermally activated by processings at steps S102 and S103 and therefore, transcribed onto the thermosensible adhering label 60 and is discharged to outside of the thermally activating unit as it is.

Further, according to the embodiment, a length of carrying the thermosensible adhering label 60 is adjusted by rotating the thermally activating platen roller 52 regularly for 3 seconds to thereby adhere the thermally activated remaining substance to remove efficiently. Further, the thermosensible adhesive of the thermosensible adhering label 60 is prevented from being thermally activated by stopping to heat the thermally activating thermal head and therefore, there is not a concern that the remaining substance is produced newly by carrying the thermosensible adhering label 60 in the cleaning operation. However, the processing at step S106 may be started after several seconds such that after stopping to apply thermal energy to the remaining substance by the thermally activating thermal head 51 (step S103), the thermosensible adhesive of the thermosensible adhering label 60 is prevented from being thermally activated by remaining heat thereof.

Next, after carrying the thermosensible adhering label 60 by a predetermined length, at step S107, the operation stops carrying the thermosensible adhering label 60 and cuts the thermosensible adhering label 60 by the cutter unit 40 at step S108 (FIG. 4(*d*)).

Next, at step S109, the carried thermosensible adhering label 60 is reeled back by rotating the thermally activating platen roller 52 reversely for 1 second (FIG. 4(*e*)), successively, at step S110, the thermosensible adhering label 60 is carried again by rotating the thermally activating platen roller 52 regularly for 1 second (FIG. 4(*f*)). In this way, the remaining substance (carbonized substance or the like) fixedly adhered to the thermally activating thermal head 51 can physically be removed by utilizing friction by frontward and rearward-movement of the thermosensible adhering label 60. At this occasion, the remaining substance adhered to the thermally activating platen roller 52 can be removed by transcribing operation.

Next, after repeating the processing of the frontward and rearward movement of the thermosensible adhering label 60 at steps S109 through S111, the operation proceeds to step S112 to rotate the thermally activating thermal printer 52 and the inserting roller 53 regularly and carry and abandon the thermosensible adhering label 60 adhered with the remaining substance (FIG. 4(*g*)).

By the above-described processing, the remaining substance adhered to the thermally activating thermal head 51 and the thermally activating platen roller 52 can easily be removed and therefore, an efficiency of conducting heat from the thermally activating thermal head 51 to the thermosensible adhering sheet 60 is not extremely reduced and power consumption required for the thermally activating processings can be avoided from being increased. Further, in comparison with the conventional method of cleaning by disassembling the thermally activating apparatus, time and labor required for cleaning is reduced and therefore, a reduction in cost can be achieved.

Further, although according to the embodiment, the thermosensible adhering label is used, an exclusive sheet for cleaning can also be utilized. In this case, the cleaning sheet may be carried while being heated by the thermally activating thermal head 51. However, in this case, the thermosensible adhering label 60 and the cleaning sheet contained in the roll containing unit 20 need to interchange.

Further, although with regard to the frontward and rearward movement of the thermosensible adhering label 60, according to the embodiment, the thermally activating platen roller 51 is rotated regularly and reversely respectively for 1 second, regular rotation and reverse rotation may be switched by a comparatively small angle such that the frontward and rearward movement is carried out little by little.

Figure 5:
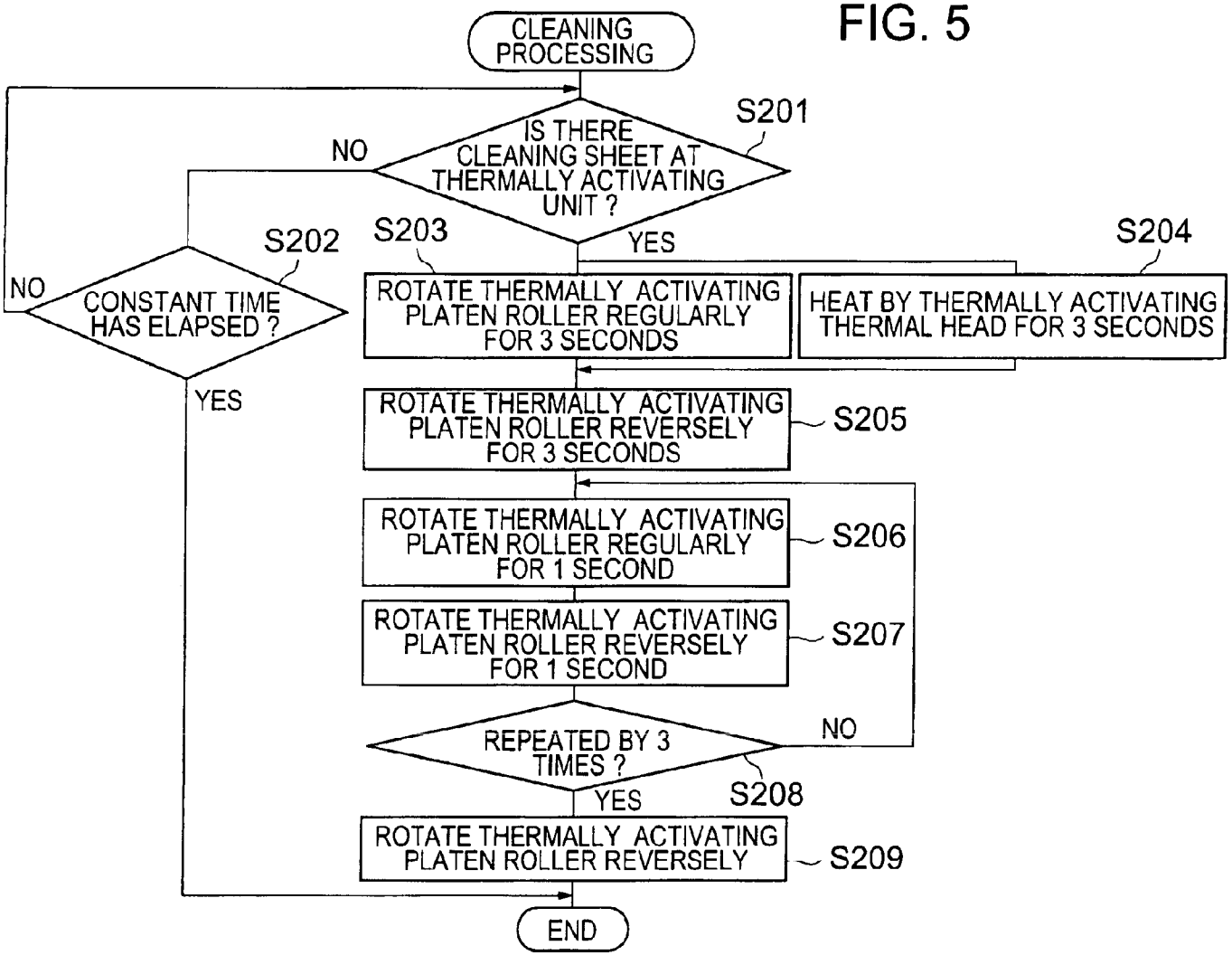
FIG. 5 is a flowchart according to a second example of the cleaning control processing.
Figure 6A:
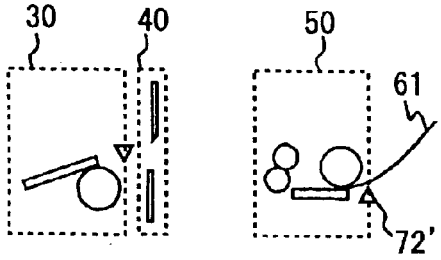
FIG. 6 illustrates operation explanatory views of the printer apparatus in a cleaning processing by the flowchart of FIG. 5.
Figure 6B:
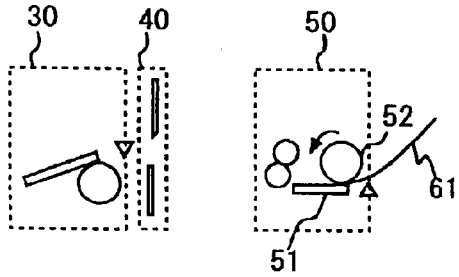
Figure 6C:
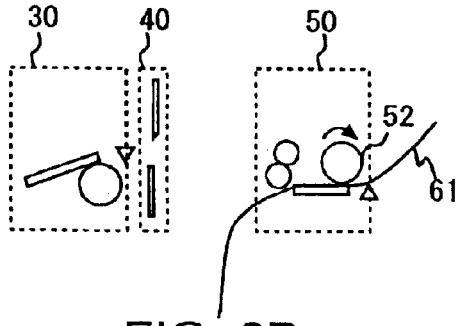
Figure 6D:
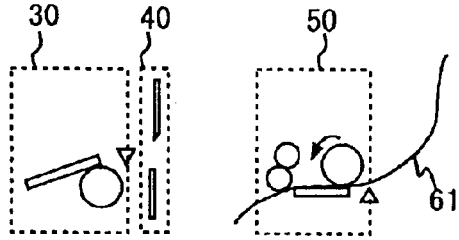
Figure 6E:
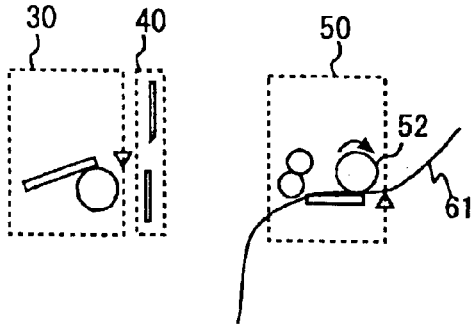
Figure 6F:
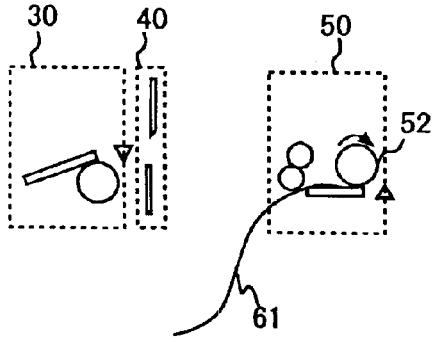

Next, an explanation will be given of a second example of cleaning processings according to the embodiment in reference to a flowchart of FIG. 5 and an operation explanatory view of FIG. 6. According to the embodiment, the cleaning processings are carried out by using exclusive cleaning sheet and supplying cleaning sheet 61 from a sheet discharge side of the thermally activating unit 50. Further, the cleaning processings are started based on operation of a cleaning switch by a user.

First, when the cleaning switch is operated by the user, at step S201, it is determined whether the cleaning sheet 61 is present in the thermally activating unit 50 (FIG. 6(*a*)). Specifically, it is determined based on a detecting signal of a second label detecting sensor 72' provided on the sheet delivery port side of the thermally activating unit 50. For example, in a state as shown by FIG. 6(*a*), it is determined that the cleaning sheet 61 is present at inside of the thermally activating unit 50.

When it is determined that the cleaning sheet 61 is not present at step S201, the operation proceeds to step S202 and determines whether a constant time period has elapsed. Further, when it is determined that the constant time period has elapsed at step S202, the cleaning sheet is not prepared despite the operation of the cleaning switch by the user, the cleaning processings cannot be executed and therefore, the processings are finished as they are. Meanwhile, when it is determined that the constant time period has not elapsed at step S201, the operation returns to step S201 to continue the processings.

When it is determined that the cleaning sheet 61 is present at step S201, the operation proceeds to step S203 to rotate the thermally activating platen roller 52 regularly (counterclockwise direction in FIG. 6) and heat the cleaning sheet 61 by the thermally activating thermal head 51 at step S204 (FIG. 6(*b*)). Further, the processings at steps S203 and S204 are carried out simultaneously and the respective operation is stopped after 3 seconds. However, the cleaning sheet 61 used in the example is not provided with the thermosensible adhesive layer and therefore, operation of the thermally activating thermal head 51 is not particularly restricted but may carry out the heating processing continuously.

Thereby, the remaining substance adhered to the thermally activating thermal head 51 and the thermally activating platen roller 52 is thermally activated and the remaining substance adhered to the sheet delivery side of the thermally activating thermal head 51 is moved to the sheet inserting side to accumulate.

Next, the operation proceeds to step S205 to rotate the thermally activating platen roller 52 reversely (clockwise rotation in FIG. 6) to carry the thermosensible adhering label 60 for 3 second in the thermally activating unit 50 (FIG. 6(*c*)). At this occasion, the remaining substance adhered to the thermally activating thermal head 51 and thermally activating platen roller 52 has been thermally activated by the processings at steps S203 and S204 and therefore, transcribed onto the thermosensible adhering label 60 to discharge to outside of the thermally activating unit 50 as it is. Further, in this example, an exclusive sheet discharge port for discharging the carried cleaning sheet 61 to outside of the thermally activating unit 50 is provided on a lower side of the inserting roller 53.

Next, at step S206, the carried thermosensible adhering label 60 is reeled back by rotating the thermally activating platen roller 52 regularly for 1 second (FIG. 6(*d*)), successively, at step S207, the cleaning sheet 61 is carried again by rotating the thermally activating platen roller 52 reversely for 1 second (FIG. 6(*e*)). By frontward and rearward movement of the thermosensible adhering label 60 in this way, the remaining substance adhered to the thermally activating platen roller 52 can be transcribed onto the cleaning sheet 61 to remove and the remaining substance (carbonized substance or the like) fixedly adhered to the thermally activating thermal head 51 can physically be moved by utilizing friction.

Next, at step S208, it is determined whether processings of the frontward and rearward movement of the cleaning sheet 61 by step S206 and step S207 are repeated by 3 times. Further, when it is determined that the predetermined processings have been repeated by 3 times at step S208, the operation proceeds to step S209 to rotate the thermally activating platen roller 52 reversely to carry the cleaning sheet 61 adhered with the remaining substance to abandon (FIG. 6(*f*)).

As described above, when the exclusive cleaning sheet is used, by constructing a constitution capable of supplying the sheet from the sheet discharge side of the thermally activating unit 50, the cleaning processing can be carried out while holding the thermosensible adhering label at the label holding portion 20. Further, the processings can be carried out only by controlling the thermally activating unit 50 with no need of controlling the printing unit 30 and the cutter unit 40 and therefore, a control program can be simplified. Further, the printer apparatus 10 may be provided with a pertinent jig (sheet holding means or the like) for inserting or delivering the cleaning sheet 61 to and from the thermally activating unit 50.

As described above, a specific explanation has been given of the invention carried out by the inventors based on the embodiments, the invention is not limited to the embodiments but can variously be modified within a range not deviated from the gist.

For example, although according to the embodiment, an explanation has been given of the invention applied to the printing apparatus of the thermosensible type such as the thermal printer apparatus, the invention is applicable also to a thermally transcribing system, an ink jet system, a laser printing system or the like. In such a case, there is used a label in which a printable face of the label is subjected to a fabrication suitable for each printing system in place of the thermosensible printing layer.

Further, although according to the embodiments, the thermally activating thermal head 51 of the thermally activating unit 50 is used also as heating means for cleaning, the heating means for cleaning may separately be provided. Further, although according to the second example, the thermally activating platen roller 52 is used also as carrying means for cleaning, a roller may further be provided on the delivery side of the thermally activating unit 50.

Further, it is preferable that the cleaning sheet is constituted by a structure provided with a shape easy to remove the adhering substance (for example, file-like shape) on the thermal head side of the sheet and provided with a layer comprising a material to which the adhering substance is easy to transcribe on the platen roller side.

Further, although according to the embodiments, an explanation has been given of the cleaning processings of the thermally activating unit 50, the embodiment is applicable also to cleaning processings of the printing unit.

According to the invention, by making the heating means (for example, the thermally activating thermal head) generate heat to apply thermal energy to the remaining substance adhered to the thermally activating thermal head and the thermally activating platen roller to thermally activate and thereafter carrying the cleaning sheet by operating the carrying means (including the thermally activating platen roller), the remaining substance adhered to the thermally activating platen roller is transcribed to the surface of the cleaning sheet to remove, the remaining substance adhered to the thermally activating thermal head is transcribed to a rear face thereof to remove and therefore, the remaining substance adhered to the thermally activating thermal head and the thermally activating platen roller can easily be removed and automation of the cleaning processings can also be carried out. Therefore, there are achieved effects of preventing the efficiency of conducting heat from the thermally activating thermal head to the thermosensible adhering sheet from being reduced extremely and enabling to avoid power consumption required for the thermally activating processings from being increased. Further, in comparison with the conventional method of cleaning by disassembling the thermally activating apparatus, time and labor required for cleaning is reduced and therefore, an effect of capable of achieving a reduction in cost is achieved.

What is claimed is:

1. A thermally activating apparatus of a thermosensible adhering sheet comprising:

a thermally activating thermal head for heating to activate a thermosensible adhesive layer of the thermosensible adhering sheet constituted by respectively forming a printable face on one side of a sheet-like base member and the thermosensible adhesive layer on other face thereof;

a thermally activating platen roller arranged to be opposed to the thermally activating thermal head for pinching the thermosensible adhering sheet between the thermally activating platen roller and the thermally activating thermal head to carry in a predetermined direction; and controlling means for controlling to drive the thermally activating thermal head and the thermally activating platen roller;

wherein, in a state in which the thermosensible adhering sheet is not disposed between the thermally activating thermal head and the thermally activating platen roller, the controlling means applies a thermal energy to a remaining substance comprising a thermosensible adhesive or a denatured substance thereof or the like adhered to the thermally activating thermal head and the thermally activating platen roller by making the thermally activating thermal head generate heat and carries a cleaning sheet between the thermally activating platen roller and the thermally activating thermal head by rotating the thermally activating platen roller to thereby transcribe the thermally activated remaining substance onto the cleaning sheet to remove.

2. The thermally activating apparatus of a thermosensible adhering sheet according to claim 1, wherein, when the thermal energy is applied to the remaining substance by making the heating means or the thermally activating thermal head generate heat, the controlling means rotates the thermally activating platen roller in a predetermined direction.

3. The thermally activating apparatus of a thermosensible adhering sheet according to claim 1, wherein, after the cleaning sheet is inserted into the thermally activating apparatus to carry by a predetermined length by operating the carrying means or the thermally activating platen roller, the controlling means removes the remaining substance by moving the cleaning sheet frontwardly and rearwardly.

4. The thermally activating apparatus of a thermosensible adhering sheet according to claim 1, wherein, when the thermosensible adhering sheet is used as the cleaning sheet, before inserting the thermosensible adhering sheet into the thermally activating apparatus, the controlling means stops applying the thermal energy to the remaining substance by the heating means or the thermally activating thermal head.

5. The thermally activating apparatus of a thermosensible adhering sheet according to claim 1, further comprising:

sheet length measuring means for measuring a length of subjecting the thermosensible adhering sheet to a thermally activating processing;

wherein the controlling means executes a cleaning processing based on a sheet length measured by the sheet length measuring means.

6. The thermally activating apparatus of a thermosensible adhering sheet according to claim 1, wherein the controlling means can control a sheet carrying direction by the carrying means or the thermally activating platen roller based on a direction of inserting the cleaning sheet into the thermally activating apparatus.

7. A printer apparatus comprising:

the thermally activating apparatus of the thermosensible adhering sheet according to claim 1; and printing means for printing the thermosensible adhering sheet;

wherein the thermally activating apparatus and the printing means are controlled by the same control apparatus.

8. A thermally activating apparatus of a thermosensible adhering sheet comprising:

a thermally activating thermal head for heating to activate a thermosensible adhesive layer of the thermosensible adhering sheet constituted by respectively forming a printable face on one side of a sheet-like base member and the thermosensible adhesive layer on other face thereof;

a thermally activating platen roller arranged to be opposed to the thermally activating thermal head for pinching the thermosensible adhering sheet between the thermally activating platen roller and the thermally activating thermal head to carry in a predetermined direction;

controlling means for controlling to drive the thermally activating thermal head and the thermally activating platen roller;

heating means for applying a thermal energy to a remaining substance comprising a thermosensible adhesive or a denatured substance thereof or the like adhered to the thermally activating thermal head and the thermally activating platen roller; and carrying means capable of carrying a predetermined cleaning sheet into the thermally activating apparatus from a predetermined direction;

wherein the controlling means is constituted to be able to control a processing of driving the heating means and carrying means for applying a thermal energy to the remaining substance by making the heating means generate heat in a state in which the thermosensible adhering sheet is not disposed between the thermally activating thermal head and the thermally activating platen roller and carrying the cleaning sheet between the thermally activating thermal head and the thermally activating platen roller by operating the carrying means to thereby transcribe the thermally activated remaining substance onto the cleaning sheet to remove.

9. The thermally activating apparatus of a thermosensible adhering sheet according to claim 8, wherein, when the thermal energy is applied to the remaining substance by making the heating means or the thermally activating thermal head generate heat, the controlling means rotates the thermally activating platen roller in a predetermined direction.

10. The thermally activating apparatus of a thermosensible adhering sheet according to claim 8, wherein, after the cleaning sheet is inserted into the thermally activating apparatus to carry by a predetermined length by operating the carrying means or the thermally activating platen roller, the controlling means removes the remaining substance by moving the cleaning sheet frontwardly and rearwardly.

11. The thermally activating apparatus of a thermosensible adhering sheet according to claim 8, wherein, when the thermosensible adhering sheet is used as the cleaning sheet, before inserting the thermosensible adhering sheet into the thermally activating apparatus, the controlling means stops applying the thermal energy to the remaining substance by the heating means or the thermally activating thermal head.

12. The thermally activating apparatus of a thermosensible adhering sheet according to claim 8, further comprising:

sheet length measuring means for measuring a length of subjecting the thermosensible adhering sheet to a thermally activating processing;

wherein the controlling means executes a cleaning processing based on a sheet length measured by the sheet length measuring means.

13. The thermally activating apparatus of a thermosensible adhering sheet according to claim 8, wherein the controlling means can control a sheet carrying direction by the carrying means or the thermally activating platen roller based on a direction of inserting the cleaning sheet into the thermally activating apparatus.

14. A printer apparatus comprising:

the thermally activating apparatus of the thermosensible adhering sheet according to claim 8; and printing means for printing the thermosensible adhering sheet;

wherein the thermally activating apparatus and the printing means are controlled by the same control apparatus.

* * * * *